US008342634B2

(12) United States Patent
Matsuhashi

(10) Patent No.: US 8,342,634 B2
(45) Date of Patent: Jan. 1, 2013

(54) PRINTING APPARATUS

(75) Inventor: Kunihiko Matsuhashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 280 days.

(21) Appl. No.: 12/817,019

(22) Filed: Jun. 16, 2010

(65) Prior Publication Data

US 2010/0315460 A1 Dec. 16, 2010

(30) Foreign Application Priority Data

Jun. 16, 2009 (JP) ..... 2009-143502
Apr. 28, 2010 (JP) ..... 2010-103837

(51) Int. Cl.
*B41J 29/38* (2006.01)
*B41J 2/01* (2006.01)

(52) U.S. Cl. ..... 347/16; 347/104

(58) Field of Classification Search ..... 347/16, 347/104

See application file for complete search history.

(56) References Cited

U.S. PATENT DOCUMENTS

| | | | | |
|---|---|---|---|---|
| 5,568,246 | A * | 10/1996 | Keller et al. | 399/382 |
| 6,101,364 | A * | 8/2000 | Boehmer et al. | 399/361 |
| 7,024,152 | B2 * | 4/2006 | Lofthus et al. | 399/391 |
| 7,245,844 | B2 * | 7/2007 | de Jong et al. | 399/69 |
| 7,324,779 | B2 * | 1/2008 | Anderson et al. | 399/341 |
| 7,336,920 | B2 * | 2/2008 | Anderson et al. | 399/341 |
| 7,387,297 | B2 * | 6/2008 | Moore | 271/10.11 |
| 7,421,241 | B2 * | 9/2008 | deJong et al. | 399/381 |
| 7,540,484 | B2 * | 6/2009 | Mandel et al. | 271/9.04 |
| 7,566,053 | B2 * | 7/2009 | Mandel et al. | 271/186 |
| 7,604,327 | B2 * | 10/2009 | Sugahara | 347/56 |
| 7,753,367 | B2 * | 7/2010 | Mandel et al. | 271/171 |
| 7,963,518 | B2 * | 6/2011 | Moore | 271/65 |
| 8,104,859 | B2 * | 1/2012 | Katoh | 347/18 |
| 8,128,088 | B2 * | 3/2012 | Suh et al. | 271/288 |
| 2006/0039728 | A1 * | 2/2006 | deJong et al. | 399/381 |
| 2007/0140767 | A1 * | 6/2007 | Mandel et al. | 399/381 |
| 2010/0067965 | A1 * | 3/2010 | Bober et al. | 399/397 |
| 2010/0194801 | A1 * | 8/2010 | Hibi | 347/9 |
| 2011/0164894 | A1 * | 7/2011 | Dobbertin et al. | 399/85 |

FOREIGN PATENT DOCUMENTS

| | | |
|---|---|---|
| JP | 06-340137 | 12/1994 |
| JP | 08-211673 | 8/1996 |
| JP | 10-218457 | 8/1998 |
| JP | 2002-301808 | 10/2002 |

* cited by examiner

*Primary Examiner* — Julian Huffman
(74) *Attorney, Agent, or Firm* — Workman Nydegger

(57) ABSTRACT

A printing apparatus includes: a first printing unit group, a second printing unit group, a turnover unit and a control unit controlling the path change unit. The control unit controls the path change unit so that a difference is as small as possible between the length of the path along which the printing medium is transported from at least one printing unit of the first printing unit group to several printing units of the second printing unit group via the turnover unit and the length of the path along which the printing medium is transported from another printing unit of the first printing unit group to several printing units of the second printing unit group via the turnover unit.

2 Claims, 5 Drawing Sheets

PRINTING APPARATUS

BACKGROUND

1. Technical Field

The present invention relates to a printing apparatus including printing units capable of executing printing on a print surface of a printing medium and allowing the printing units to execute the printing in parallel.

2. Related Art

There is known a printing apparatus including a plurality of printing units capable of executing printing on a print surface of a printing medium and allowing the printing units to execute the printing in parallel. For example, there is a printing apparatus which includes a plurality of printing units arranged in a vertical direction and a unit discharging a printing medium discharged from the printing units to a common sheet receiver (for example, see JP-A-8-211673). The printing apparatus is capable of causing the plurality of printing units to simultaneously print a plurality of printing media in parallel when continuously printing the plurality of printing media. According to the known technique, it is possible to improve throughput of the printing apparatus.

The printing apparatus including a turnover unit turning over the front and rear surfaces of the printing medium is capable of executing printing on the front and rear surface of the printing medium. Therefore, by disposing the turnover unit in the printing apparatus including the plurality of printing units capable of executing the printing on the print surface of the printing medium and allowing the printing units to execute the printing in parallel, the printing apparatus can realize the printing on both sides of the printing medium at a high speed. While one printing unit executes the printing on the rear surface of the printing medium after the printing on the front surface of the printing medium, another printing unit can execute the printing on the front surface of the next printing medium in parallel. Therefore, the printing can be executed on both surfaces of the printing medium more efficiently.

However, the length of a transport path of the printing medium between the printing units is different depending on how the printing unit used when executing front surface printing and the printing unit used when executing rear surface printing are selected. Completing the printing on both surfaces of the printing medium tends to be more time-consuming, as the transport path of the printing medium between the printing units becomes longer. Therefore, in order to execute the printing on both surfaces of the plurality of printing media simultaneously, a bottleneck may occur in the printing medium transported along the longest path between the printing units. Therefore, the improvement in throughput may not be achieved.

SUMMARY

An advantage of some aspects of the invention is that it provides a technique for improving throughput upon both-surface printing in a printing apparatus including printing units capable of executing printing on a print surface of a printing medium and allowing the printing units to execute the printing in parallel.

According to an aspect of the invention, there is provided a printing apparatus which includes: a first printing unit group having a plurality of printing units executing printing on a print surface of a printing medium, the plurality of printing units executing the printing in parallel; a second printing unit group having a plurality of printing units executing printing on the print surface of the printing medium, the plurality of printing units executing the printing in parallel; a turnover unit turning over front and rear surfaces of the printing medium sent from the first printing unit group; a path change unit changing a path, along which the printing medium is transported from the first printing unit group to the second printing unit group via the turnover unit, to any one of a plurality of paths corresponding to the printing units of the second printing unit group; and a control unit controlling the path change unit. The control unit controls the path change unit so that the difference is as small as possible between the length of the path along which the printing medium is transported from at least one printing unit of the first printing unit group to several printing units of the second printing unit group via the turnover unit and the length of the path along which the printing medium is transported from another printing unit of the first printing unit group to several printing units of the second printing unit group via the turnover unit.

In the printing apparatus having this configuration, the plurality of printing units of the first printing unit group can print the front surfaces of the plurality of printing media in parallel, the turnover unit turns over the front and rear surfaces of the printing media after the front surfaces of the printing media are subjected to the printing. The plurality of printing units of the second printing unit group can print the rear surfaces of the plurality of printing media in parallel. That is, the printing apparatus with the above-described configuration can print both surfaces of the plurality of printing media. For example, the front surface of one printing medium is printed by any one printing unit of the first printing unit group and the front surface of another printing medium is printed in parallel by another printing unit of the first printing unit group. The plurality of printing media after the front surfaces of the printing media is printed is turned over by the turnover unit and sent to the second printing unit group. At this time, the rear surface of one turned over printing medium is printed by any one printing unit of the second printing unit group and the rear surface of another turned over printing medium is printed in parallel by another printing unit of the second printing unit group.

Here, the relative positions of the printing units of the first printing unit group, the printing units of the second printing unit group, and the turnover unit are determined in various forms depending on the shape of the printing apparatus. Therefore, the lengths of the paths along which the printing media are transported during the both-surface printing may be different depending on which printing unit of the first printing unit group prints the front surface of the printing medium and which printing unit of the second printing unit group prints the rear surface of the printing medium. The length of the path along which the printing medium is transported during the both-surface printing of the printing medium has an influence on throughput when the both-surface printing of the printing medium is executed. That is, as the path along which the printing medium is transported during the both-surface printing of the printing medium becomes longer, it takes more time to transport the printing medium. Therefore, it may take more time to execute the both-surface printing of the printing medium. For this reason, when the both-surface printing is executed on the plurality of printing media, the time at which the both-surface printing of all the printing media is completed is the time at which the both-surface printing of the printing medium transported along the longest path is completed.

The printing apparatus having the above-mentioned configuration changes the path of the printing medium so that the difference is as small as possible between the length of the path along which the printing medium is transported from one printing unit of the first printing unit group to several printing units of the second printing unit group via the turnover unit and the length of the path along which the printing medium is transported from another printing unit of the first printing unit group to several printing units of the second printing unit group via the turnover unit. That is, when the both-surface printing of the plurality of printing media is executed in parallel, the lengths of the paths along which the printing media are transported can be made nearly the same. Therefore, it is possible to solve the problem that it takes significantly more time to completely print both surfaces of the plurality of printing media since the path of only one printing medium becomes significantly long. Accordingly, it is possible to improve the throughput at the time of executing the both-surface printing of the plurality of printing media.

The printing apparatus according to the aspect of the invention includes the plurality of printing units printing the print surface of the printing medium. Therefore, an advantage can be obtained in that it is possible to improve the throughput at the time of executing the both-surface printing in the printing apparatus in which the printing units execute the printing in parallel.

In the printing apparatus according to the aspect of the invention, the first printing unit group may include first, second, and third printing units and the second printing unit group includes fourth, fifth, and sixth printing units. Among paths from the printing units of the first printing unit group to an entrance of the second printing unit group via the turnover unit, the path from the first printing unit may be the longest, the path from the second printing unit may be the next longest, and the path from the third printing unit may be the shortest. Among paths from the entrance of the second printing unit group to the printing units of the second printing unit group, the path reaching the fourth printing unit may be the longest, the path reaching the fifth printing unit may be the next longest, and the path reaching the sixth printing unit may be the shortest. The control unit may control the path change unit so that the printing medium of which the front surface is printed by the first printing unit is transported to the sixth printing unit to print the rear surface of the printing medium, the printing medium of which the front surface is printed by the second printing unit is transported to the fifth printing unit to print the rear surface of the printing medium, and the printing medium of which the front surface is printed by the third printing unit is transported to the fourth printing unit to print the rear surface of the printing medium.

With such a configuration, when the both-surface printing of the plurality of printing media is executed in parallel by the first printing unit group having at least three printing units and the second printing unit group having at least three printing units of the printing apparatus, the lengths of the paths along which the printing media are transported can be made nearly the same. Therefore, it is possible to solve the problem that it takes more time to completely print both surfaces of the plurality of printing media since the path of only one printing medium becomes significantly long. Accordingly, in the printing apparatus with the above-described configuration, it is possible to improve the throughput at the time of executing the both-surface printing of the plurality of printing media.

In the printing apparatus according to the aspect of the invention, a path may be provided to transport the printing medium before the printing to the second printing unit group without passing through the first printing unit group.

With such a configuration, when one-surface printing (where only the front surface is printed) of the printing medium is executed, the printing units of the first and second unit groups can execute the one-surface printing of the plurality of media. Accordingly, it is possible to considerably improve the throughput at the time of executing one-surface printing of the plurality of printing media.

According to another aspect of the invention, there is provided a printing apparatus including: a printing unit group having a plurality of printing units executing printing on a print surface of a printing medium, the plurality of printing units executing the printing in parallel; a turnover unit turning over front and rear surfaces of the printing medium sent from the printing unit group; a path change unit changing a path, along which the printing medium is transported from the printing unit group to the printing unit group again via the turnover unit, to any one of a plurality of paths corresponding to the printing units of the printing unit group; and a control unit controlling the path change unit. The control unit controls the path change unit so that a difference is the smallest between the length of the path along which the printing medium is transported from at least one printing unit of the printing unit group to several printing units of the printing unit group via the turnover unit and the length of the path along which the printing medium is transported from another printing unit of the printing unit group to several printing units of the printing unit group via the turnover unit.

In the printing apparatus having the aspect of the invention, when the both-surface printing of the plurality of printing media is executed in parallel, the lengths of the paths along which the printing media are transported can be made nearly the same, as in the above-described aspect of the invention. Therefore, it is possible to solve the problem that it takes more time to completely print both surfaces of the plurality of printing media since the path of only one printing medium becomes significantly long. Accordingly, in the printing apparatus with the above-described configuration, it is possible to improve the throughput at the time of executing the both-surface printing of the plurality of printing media.

The printing apparatus according to the aspect of the invention includes the plurality of printing units printing the print surfaces of the printing media. Therefore, an advantage can be obtained in that it is possible to improve the throughput at the time of executing the both-surface printing in the printing apparatus in which the printing units execute the printing in parallel.

In the printing apparatus according to the aspect of the invention, the printing unit group may include first, second, and third printing units. Among paths from the printing units of the printing unit group to the turnover unit, the path from the first printing unit may be the longest, the path from the second printing unit may be the next longest, and the path from the third printing unit may be the shortest. Among paths from the turnover unit to the printing units of the printing unit group, the path reaching the first printing unit may be the longest, the path reaching the second printing unit may be the next longest, and the path reaching the third printing unit may be the shortest. The control unit may control the path change unit so that the printing medium of which the front surface is printed by the first printing unit is transported to the third printing unit to print the rear surface of the printing medium, the printing medium of which the front surface is printed by the second printing unit is transported to the second printing unit to print the rear surface of the printing medium, and the printing medium of which the front surface is printed by the third printing unit is transported to the first printing unit to print the rear surface of the printing medium.

With such a configuration, when the both-surface printing of the plurality of printing media is executed in parallel by the printing unit group having at least three printing units of the printing apparatus, the lengths of the paths along which the printing media are transported can be made nearly the same. Therefore, it is possible to solve the problem that it takes more time to completely print both surfaces of the plurality of printing media since the path of only one printing medium becomes significantly long. Accordingly, in the printing apparatus with the above-described configuration, it is possible to improve the throughput at the time of executing the both-surface printing of the plurality of printing media.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the drawings. The invention is not limited to the embodiments described below, but may be modified in various forms within the scope of the invention described in the appended claims. Of course, the modifications are included in the scope of the invention.

Configuration of Printing Unit

First, printing units forming a "printing unit group" will be described.

Figure 1:
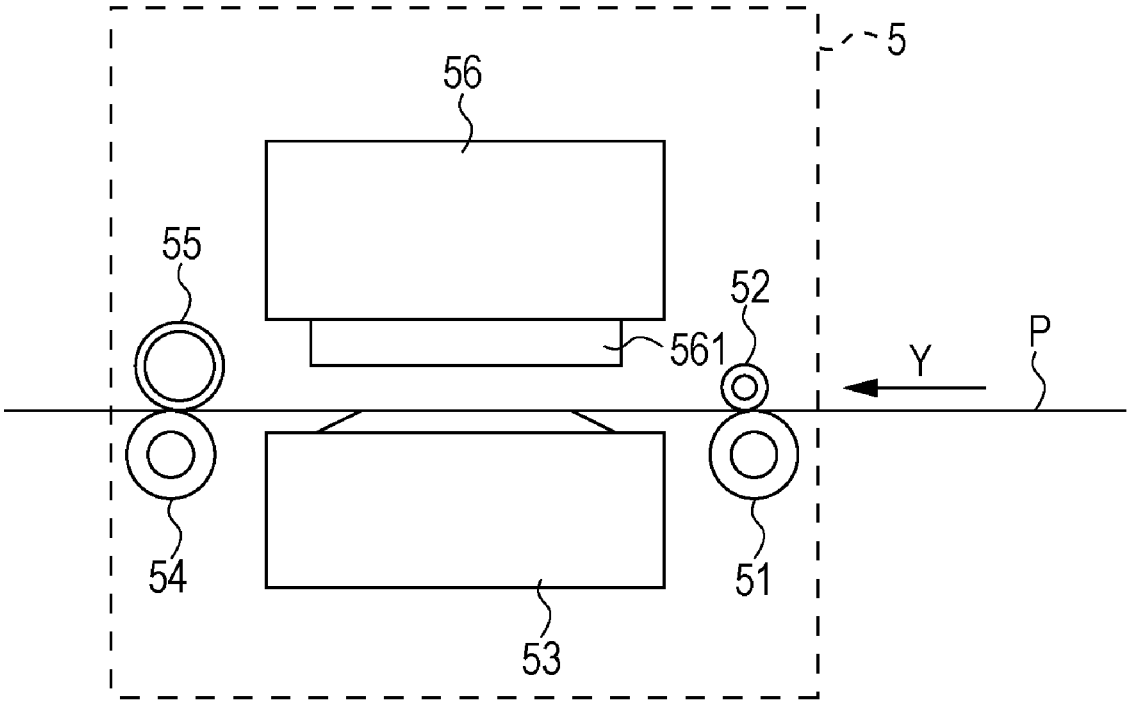
FIG. 1 is a side view schematically illustrating the major units of a printing unit.

FIG. 1 is a side view schematically illustrating the major units of the printing unit.

The printing unit 5 includes a transport driving roller 51, a transport driven roller 52, a platen 53, a discharge driving roller 54, a discharge driven roller 55, a carriage 56, and a printing head 561 as units executing printing on a printing sheet P.

The transport driving roller 51 has a high-frictional coated layer on the outer circumferential surface. The transport driving roller 51 is rotated when a rotation driving force of a transport motor (not shown) is delivered to the transport driving roller 51. The transport driven roller 52 is axially supported so as to be driven and rotated in a state where the transport driven roller 52 is urged in a direction in which the transport driven roller 52 comes into contact with the transport driving roller 51. The platen 53 supports the printing sheet P from the rear surface of the printing sheet P. A distance between the head surface of the printing head 561 and the print surface (surface on which the printing is executed) of the printing sheet P is maintained at a given interval by the platen 53. The discharge driving roller 54 is rotated when a rotation driving force of a transport motor (not shown) is delivered to the discharge driving roller 54. The discharge driven roller 55 is axially supported so as to be driven and rotated and is also urged in a direction in which the discharge driven roller 55 comes into contact with the discharge driving roller 54.

The carriage 56 is supported so as to reciprocate in a main scanning direction. The main scanning direction refers to a direction intersecting a sub-scanning direction Y along the print surface of the printing sheet P supported by the platen 53. The carriage 56 is connected to an endless belt suspended between a driving pulley and a driven pulley of a carriage driving motor (not shown). The carriage 56 reciprocates in the main scanning direction by rotating the carriage driving motor in both directions. The printing head 561 is mounted on the carriage 56 so that the head surface of the printing head 561 faces the print surface of the printing sheet P supported by the platen 53. A plurality of ejection nozzles (not shown) ejecting ink to the print surface of the print sheet P to form dots is arranged in the head surfaces of the printing head 561.

The printing sheet P fed to the printing unit 5 is pinched by the transport driving roller 51 and the transport driven roller 52. Then, the printing sheet P on the platen 53 is transported in the sub-scanning direction y by the driving rotation of the transport driving roller 51. The printing is executed on the print surface of the printing sheet P on the platen 53 by repeating an operation of ejecting ink to the print surface from the head surface of the printing head 561 to form dots while reciprocating the carriage 56 in the main scanning direction and an operation of transporting the printing sheet P in the sub-scanning direction Y by a predetermined transport distance by the driving rotation of the transport driving roller 51. The printing sheet P of which the print surface is subjected to the printing is pinched between the discharge driving roller 54 and the discharge driven roller 55, is transported in the sub-scanning direction by the driving rotation of the discharge driving roller 54, and is discharged from the printing unit 5.

First Embodiment

An ink jet printer 50 according to a first embodiment of the invention will be described with reference to FIGS. 2 and 3.

Figure 2:
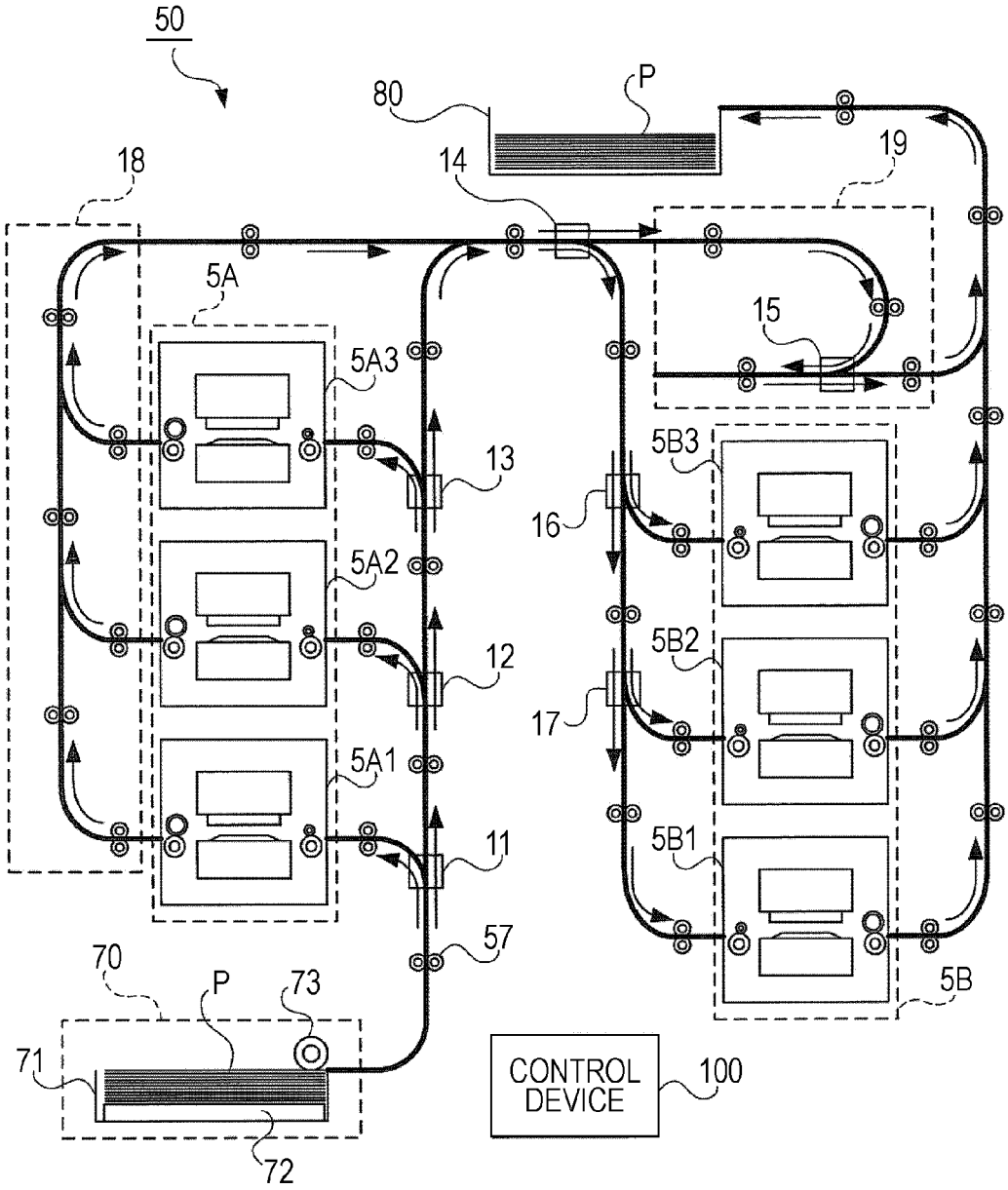
FIG. 2 is a side view schematically illustrating the major units of an ink jet printer according to a first embodiment.

FIG. 2 is a side view schematically illustrating the ink jet printer 50 according to the first embodiment. FIG. 3 is a side view schematically illustrating a branch flapper disposed in a transport path of the printing sheet.

The ink jet printer 50 according to the first embodiment includes an automatic feed device 70, a discharge tray 80, a first printing unit group 5A, a second printing unit group 5B, a plurality of transport roller pairs 57, branch flappers 11 to 17, a first turnover path section 18, a second turnover path section 19, and a control device 100.

The automatic feed device 70 includes a feeding tray 71, a hopper 72, and a feeding roller 73. The printing sheets P before printing are stacked in the feeding tray 71. The hopper 72 is disposed in the bottom of the feeding tray 71 and is urged in a direction in which the hopper 72 comes into contact with the feeding roller 73 by a spring force of a spring or the like (not shown). The feeding roller 73 is rotated when the rotation driving force of a motor (not shown) is delivered to the feeding roller 73. The printing sheet P stacked in the feeding tray 71 is pushed up from the bottom side by the hopper 72, and thus the uppermost printing sheet P comes into contact with the outer circumferential surface of the feeding roller 73. When the feeding roller 73 is rotated, the printing sheet P coming into contact with the outer circumferential surface of the feeding roller 73 is sent from the feeding tray 71.

The first printing unit group 5A includes three printing units 5A1 to 5A3 executing the printing on the print surface of the printing sheet P. The three printing units 5A1 to 5A3 can execute the printing in parallel. Similarly, the second printing unit group 5B includes three printing units 5B1 to 5B3 executing the printing on the print surface of the printing sheet P. The three printing units 5B1 to 5B3 can execute the printing in parallel. The printing units 5A1 to 5A3 and the printing units 5B1 to 5B3 are the printing unit 5 illustrated in FIG. 1.

The transport roller pair 57 includes a driving roller rotated by a rotation driving force of a motor (not shown) and a driven roller urged to and coming into contact with the driving roller. The plurality of roller pairs 57 are disposed in positions of a path (hereinafter, referred to as a "transport path") along which the printing sheet P is transported.

Hereinafter, the transport path in the ink jet printer 50 according to the first embodiment will be described.

The transport path from the automatic feed device 70 to the printing units 5A1 to 5A3 and the printing units 5B1 to 5B3 is a path (hereinafter, referred to as a "feed path") along which the printing sheet P is fed to each printing unit. The plurality of transport paths of the printing sheet P printed by the printing units 5A1 to 5A3 pass through the first turnover path section 18, join each other, and then become one transport path. The one transport path joins the feed path for the moment and then branches in the feed path. The transport paths reach the second turnover path section 19. The transport path along which the print sheet P is sent from the second turnover path section 19 reaches the discharge tray 80. The transport path along which the printing sheet P subjected to the printing in the second turnover path section 19 joins the plurality of transport paths along which the printing sheet P is sent from the printing units 5B1 to 5B3 and reaches the discharge tray 80. The printing sheet P subjected to the printing is discharged and stacked in the discharge tray 80.

The branch flappers 11 to 17 serving as "path change units" are disposed at the branch locations of the transport paths. Each branch flapper changes the transport path to either one side or the other side of the branch location. The branch flappers 11 to 17 correspond to a branch device 10 illustrated in FIG. 3. The branch device 10 includes a guide member 101 disposed pivotably and a pivot mechanism (not shown) pivoting the guide member 101. When the guide member 101 is pivoted to one side (indicated by a solid line), the printing sheet P is guided to the transport path indicated by sign A. When the guide member 101 is pivoted to the other side (indicated by a two-dot chain line), the printing sheet P is guided to the transport indicated by sign B (see FIG. 3).

The branch flapper 11 is disposed at the location at which the transport path branches from the feed path to the printing unit 5A1. The branch flapper 12 is disposed at the location at which the transport path branches from the feed path to the printing unit 5A2. The branch flapper 13 is disposed at the location at which the transport path branches from the feed path to the printing unit 5A3. The branch flapper 14 is disposed at the location at which the transport path branches from the feed path to the second turnover path section 19. The branch flapper 15 is disposed at the second turnover path section 19. The branch flapper 16 is disposed at the location at which the transport path branches from the feed path to the printing unit 5B3. The branch flapper 17 is disposed at the location at which the transport path branches from the feed path to the printing unit 5B2.

The first turnover path section 18 serving as a "turnover unit" is disposed to turn over the front and rear surfaces of the printing sheet P printed by the first printing unit group 5A. The front and rear surfaces of printing sheet P sent from the first printing unit group 5A are turned over when the printing sheet P passes through a curved portion of the first turnover path section 18. The second turnover path section 19 has a transport path for turning over the front and rear surfaces of the printing sheet P by so-called switchback. The second turnover path section 19 is installed to again turn over the front and rear surfaces of the printing sheet P turned over in the first turnover path section 18 and to discharge the printing sheet P to the discharge tray 80 when the rear surface of the printing sheet P of which the front surface is printed by the first printing unit group 5A is discharged. Therefore, the printing sheet P discharged in the state where only the front surface of the printing sheet P is printed by the first printing unit group 5A is discharged to the discharge tray 80 in a facedown state (state where the print sheet faces down).

The control device 100 is a device that has a known microcomputer control circuit. The control device 100 controls the automatic feed device 70, the printing units 5A1 to 5A3 of the first printing unit group 5A, the printing units 5B1 to 5B3 of the second printing unit 5B, the branch flappers 11 to 17, and the plurality of transport roller pairs.

When the printing is executed only on the front surfaces of the plurality of printing sheets P in the ink jet printer 50 having the above-described configuration, three printing sheets can be printed by the printing units 5A1 to 5A3 and three printing sheets can be printed by the printing units 5B1 to 5B, that is, a total of six printing sheets P can be printed in parallel. When both surfaces of the plurality of printing sheets P are printed, the front surfaces of three printing sheets can be printed in parallel by the printing units 5A1 to 5A3, and then the rear surfaces of the three printing sheets P can be printed in parallel by the printing units 5B1 to 5B3.

Among the transport paths from the first printing unit group 5A to the branch flapper 14 via the first turnover path section 18, the transport path from the printing unit 5A1 is the longest, the transport path from the printing unit 5A2 is the next longest, and the transport path from the printing unit 5A3 is the shortest. Among the transport paths from the branch flapper 14 to the second printing unit group 5B, the transport path from the printing unit 5B1 is the longest, the transport path from the printing unit 5B2 is the next longest, and the transport path from the printing unit 5B3 is the shortest. When the control device 100 of the ink jet printer 50 prints both surfaces of the plurality of printing sheets P in parallel, the control device 100 executes path turnover control so that a difference becomes as small as possible between the length of one transport path along which the printing sheet P is transported from at least one printing unit of the first printing unit group 5A to several printing units of the second printing unit group 5B via the first turnover path section 18 and another transport path (transport path which does not overlap with the one transport path) along which the printing sheet P is transported from another printing unit of the first printing unit group 5A to several printing units of the second printing unit group 5B via the first turnover path section 18.

More specifically, the printing sheets P are first fed to the printing unit 5A1, the printing unit 5A2, and the printing unit 5A3 of the first printing unit group 5A to print the front surfaces of the printing sheets P in parallel. Subsequently, the printing sheets P sent from the first printing unit group 5A after the front surfaces of the printing sheets P are completely printed are turned over by the first turnover path section 18. At this time, the branch flapper 14 is controlled so that the printing sheets P of which the front and rear surfaces are turned over are transported to the second printing unit group 5B. The branch flappers 16 and 17 execute the path turnover control so that the printing sheet P of which the front surface is printed by the printing unit 5A1 is transported to the printing unit 5B3 to print the rear surface of the printing sheet P, the printing sheet P of which the front surface is printed by the printing unit 5A2 is transported to the printing unit 5B2 to print the rear surface of the printing sheet P, and the printing sheet P of which the front surface is printed by the printing unit 5A3 is transported to the printing unit 5B1 to print the rear surface of the printing sheet P.

In this way, when the ink jet printer 50 according to the invention prints both surfaces of the plurality of printing sheets P, the ink jet printer 50 can minimize the difference between the lengths of the transport paths along which the printing sheets P are transported. That is, when the ink jet printer 50 prints both surfaces of the plurality of printing sheets P in parallel, the ink jet printer 50 can control the transport paths so that the lengths of the transport paths of the printing sheets P are nearly the same. Therefore, it is possible to solve the problem that it takes more time to completely print both surfaces of the plurality of printing sheets P since the transport path of only one printing sheet P becomes significantly long at the time of printing both surfaces of the plurality of printing sheets P in parallel. Accordingly, according to the ink jet printer 50 according to the invention, it is possible to improve the throughput at the time of executing both-surface printing.

Second Embodiment

The ink jet printer 50 according to a second embodiment of the invention will be described with reference to FIG. 4.

Figure 4:
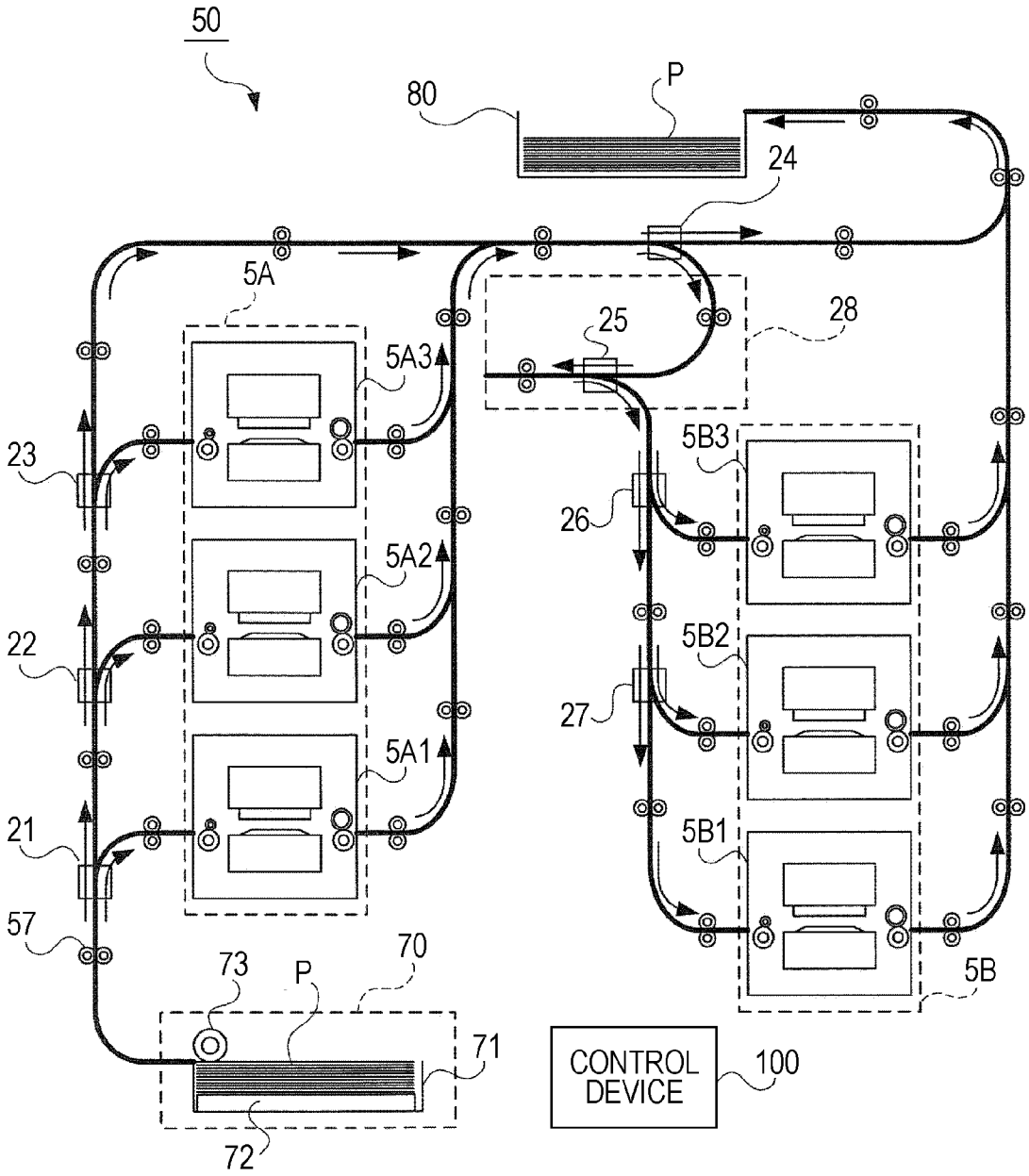
FIG. 4 is a side view schematically illustrating the major units of an ink jet printer according to a second embodiment.

FIG. 4 is a side view schematically illustrating the major units of the ink jet printer 50 according to the second embodiment.

The ink jet printer 50 according to the second embodiment includes the automatic feed device 70, the discharge tray 80, the first printing unit group 5A, the second printing unit group 5B, the plurality of transport roller pairs 57, branch flappers 21 to 27, a turnover path section 28, and the control device 100. Hereinafter, the points different from those of the first embodiment will be described in detail. The same reference numerals are given to the same constituent elements as those of the first embodiment.

A transport path from the automatic feed device 70 to the printing units 5A1 to 5A3 is a path (hereinafter, referred to as a "first feed path") along which the printing sheet P is fed from the automatic feed device 70 to the printing units 5A1 to 5A3. A transport path from automatic feed device 70 to the turnover path section 28 is a path (hereinafter, referred to as a "second feed path") along which the printing sheet P is fed from the automatic feed device 70 to the printing units 5B1 to 5B3 via the turnover path section 28. A transport path from the turnover path section 28 to the printing units 5B1 to 5B3 is a path (hereinafter, referred to as a "third feed path") along which the printing sheet P is fed to the printing units 5B1 to 5B3. The plurality of transport paths along which the printing sheet P printed by the printing units 5A1 to 5A3 is sent join the second feed path and branch to the transport path reaching the turnover path section 28 and the transport path reaching the discharge tray 80. The plurality of transport paths along which the printing sheet P printed by the printing units 5B1 to 5B3 is sent join the transport path reaching the discharge tray 80 from the branch flapper 24 and reach the discharge tray 80.

The branch flapper 21 is disposed at the location at which the transport path branches from the first feed path to the printing unit 5A1. The branch flapper 22 is disposed at the location at which the transport path branches from the first feed path to the printing unit 5A2. The branch flapper 23 is disposed at the location at which the transport path branches from the first feed path to the printing unit 5A3. The branch flapper 24 is disposed at the location at which the transport path reaching the discharge tray 80 and the transport path reaching the turnover path section 28 branch. The branch flapper 25 is disposed in the turnover path section 28. The branch flapper 26 is disposed at the location at which the transport path branches from the third feed path to the printing unit 5B3. The branch flapper 27 is disposed at the location at which the transport path branches from the third feed path to the printing unit 5B2.

Figure 3:
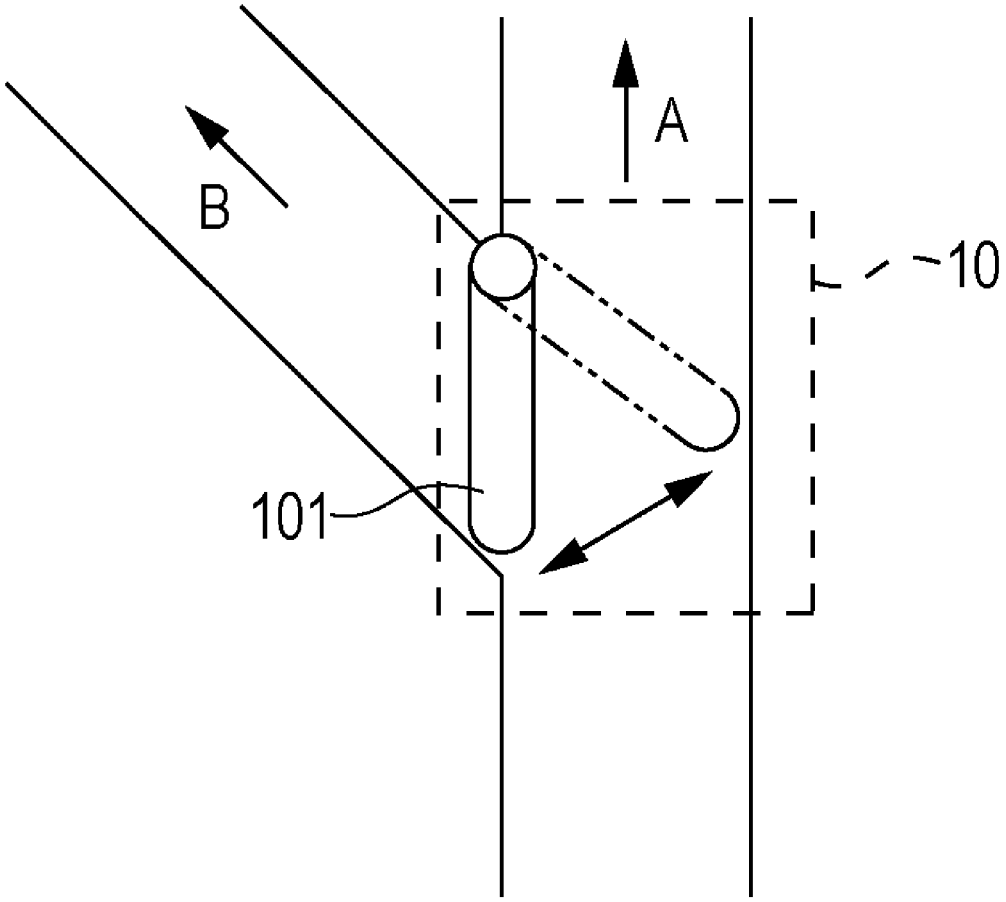
FIG. 3 is a side view schematically illustrating a branch flapper.

The branch flappers 21 to 27 correspond to the branch device 10 illustrated in FIG. 3, as in the first embodiment. The turnover path section 28 serving as the "turnover unit" has the same configuration as that of the second turnover path section 19 of the first embodiment. The turnover path section 28 is disposed to turn over the front and rear surfaces of the printing sheet P printed by the first printing unit group 5A and send the printing sheet P to the second printing unit group 5B.

Among the transport paths from the first printing unit group 5A to the turnover path section 28, the transport path from the printing unit 5A1 is the longest, the transport path from the printing unit 5A2 is the next longest, and the transport path from the printing unit 5A3 is the shortest. Among the transport paths from the turnover path section 28 to the second printing unit group 5B, the transport path reaching the printing unit 5B1 is the longest, the transport path reaching the printing unit 5B2 is the next longest, and the transport path reaching the printing unit 5B3 is the shortest. The control device 100 of the ink jet printer 50 controls both-surface printing to print the plurality of printing sheets P in parallel in the following way.

The printing sheets P are first fed to the printing unit 5A1, the printing unit 5A2, and the printing unit 5A3 of the first printing unit group 5A to print the front surfaces of the printing sheets P in parallel. At this time, the branch flapper 24 is controlled to transport the turned-over printing sheets P to the second printing unit 5B. The printing sheets P sent from the first printing unit group 5A after the front surfaces of the printing sheets P are completely printed are turned over by the turnover path section 28. The branch flappers 26 and 27 execute the path turnover control so that the printing sheet P of which the front surface is printed by the printing unit 5A1 is transported to the printing unit 5B3 to print the rear surface of the printing sheet P, the printing sheet P of which the front surface is printed by the printing unit 5A2 is transported to the printing unit 5B2 to print the rear surface of the printing sheet P, and the printing sheet P of which the front surface is printed by the printing unit 5A3 is transported to the printing unit 5B1 to print the rear surface of the printing sheet P.

In this way, as in the first embodiment, the ink jet printer 50 according to the second embodiment can control the transport paths so that the lengths of the transport paths of the printing sheets P are nearly the same when the ink jet printer 50 prints both surfaces of the plurality of printing sheets P in parallel. Accordingly, as in the first embodiment, it is possible to improve throughput at the time of executing both-surface printing.

Third Embodiment

The ink jet printer 50 according to a third embodiment of the invention will be described with reference to FIG. 5.

Figure 5:
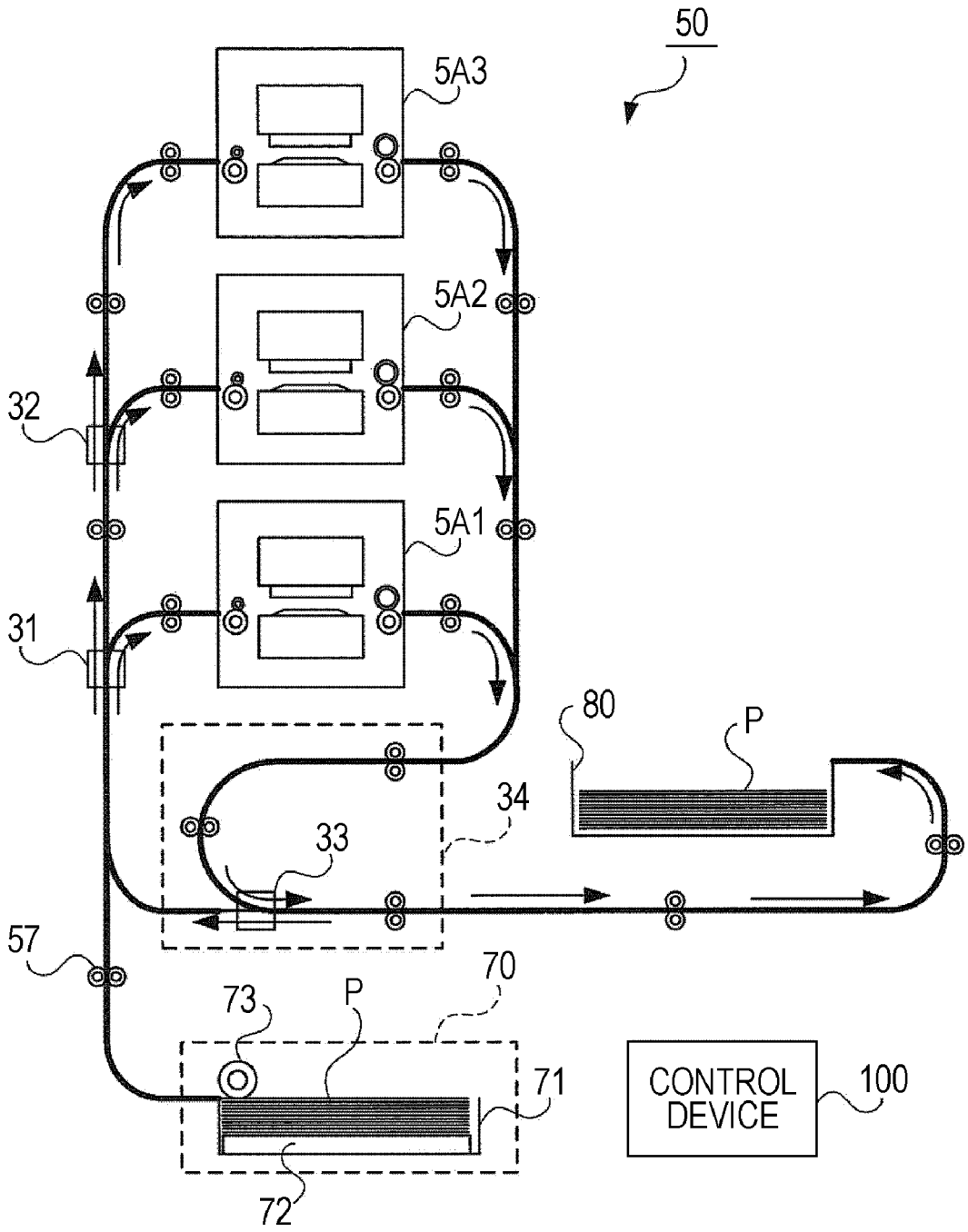
FIG. 5 is a side view schematically illustrating the major units of an ink jet printer according to a third embodiment.

FIG. 5 is a side view schematically illustrating the major units of the ink jet printer 50 according to the third embodiment.

The ink jet printer 50 according to the third embodiment includes the automatic feed device 70, the discharge tray 80, the printing units 5A1 to 5A3 as a "printing unit group", the plurality of transport roller pairs 57, branch flappers 31 to 33, a turnover path section 34, and the control device 100. Hereinafter, the different points from those of the first embodiment will be described in detail. The same reference numerals are given to the same constituent elements as those of the first embodiment.

A transport path from the automatic feed device 70 to the printing units 5A1 to 5A3 is a path (hereinafter, referred to as a "feed path") along which the printing sheet P is fed from the automatic feed device 70 to the printing units 5A1 to 5A3. The plurality of transport paths along which the printing sheet P printed by the printing units 5A1 to 5A3 is sent join each other and reach the turnover path section 34. The turnover path section 34 serving as the "turnover unit" has a transport path for turning over the front and rear surfaces of the printing sheet P by so-called switchback, like the second turnover path section 19 of the first embodiment. The turnover path section 34 is installed to turn over the front and rear surfaces of the printing sheet P printed by the printing units 5A1 to 5A3 and send the turned-over printing sheet P to the printing units 5A1 to 5A3 again. The transport path along which the printing sheet P is sent without switchback in the turnover path section 34 reaches the discharge tray 80. On the other hand, the printing sheet P turned over by the switchback in the turnover path section 34 joins the feed path.

The branch flapper 31 is disposed at the location at which the transport path branches from the feed path to the printing unit 5A1. The branch flapper 32 is disposed at the location at which the transport path branches from the feed path to the printing unit 5A2. The branch flapper 33 is disposed in the turnover path section 34. The branch flappers 31 to 33 correspond to the branch device 10 illustrated in FIG. 3, as in the first embodiment.

Among the transport paths from the printing units 5A1 to 5A3 to the turnover path section 34, the transport path from the printing unit 5A3 is the longest, the transport path from the printing unit 5A2 is the next longest, and the transport path from the printing unit 5A1 is the shortest. Among the transport paths from the turnover path section 34 to the printing units 5A1 to 5A3, the transport path reaching the printing unit 5A3 is the longest, the transport path reaching the printing unit 5A2 is the next longest, and the transport path reaching the printing unit 5A1 is the shortest. When the control device 100 of the ink jet printer 50 controls both-surface printing to print the plurality of printing sheets P in parallel, the control device 100 executes path turnover control so that a difference is as small as possible between the length of one transport path along which a first printing sheet P is transported from at least one printing unit of the printing units 5A1 to 5A3 to another printing unit of the printing units 5A1 to 5A3 via the turnover path section 34 and another transport path (another transport path which does not overlap with the one transport path) along which a second printing sheet P is transported from a second printing unit of the printing units 5A1 to 5A3 to another printing unit of the printing units 5A1 to 5A3 via the turnover path section 34.

More specifically, the printing sheets P are first fed to the printing unit 5A1, the printing unit 5A2, and the printing unit 5A3 to print the front surfaces of the printing sheets P in parallel. Subsequently, the printing sheets P sent from the printing units after the front surfaces of the printing sheets P are completely printed are turned over by the turnover path section 34. Then, the branch flappers 31 and 32 execute the path turnover control so that the printing sheet P of which the front surface is printed by the printing unit 5A1 is transported to the printing unit 5A3 to print the rear surface of the printing sheet P, the printing sheet P of which the front surface is printed by the printing unit 5A2 is transported to the printing unit 5A2 to print the rear surface of the printing sheet P, and the printing sheet P of which the front surface is printed by the printing unit 5A3 is transported to the printing unit 5A1 to print the rear surface of the printing sheet P.

In this way, as in the first embodiment, the ink jet printer 50 according to the third embodiment can control the transport paths so that the lengths of the transport paths of the printing sheets P are nearly the same when the ink jet printer 50 prints both surfaces of the plurality of printing sheets P in parallel. Accordingly, as in the first embodiment, it is possible to improve throughput at the time of executing both-surface printing.

What is claimed is:

1. A printing apparatus comprising:

a printing unit group having a plurality of printing units executing printing on a print surface of a plurality of printing mediums, the plurality of printing units executing the printing in parallel;

a turnover unit turning over front and rear surfaces of the plurality of printing mediums sent from the printing unit group;

a path change unit changing a path, along which the plurality of printing mediums are transported from the printing unit group to the printing unit group again via the turnover unit, to any one of a plurality of paths corresponding to the printing units of the printing unit group; and a control unit controlling the path change unit, wherein the control unit controls the path change unit so that a difference is as small as possible between the length of a first path along which a first printing medium is transported from one printing unit of the printing unit group to another printing unit of the printing unit group via the turnover unit and the length of a second path along which a second printing medium is transported from a second printing unit of the printing unit group to another printing unit of the printing unit group via the turnover unit.

2. The printing apparatus according to claim 1, wherein the printing unit group includes the first, the second, and a third printing units, wherein among paths from the printing units of the printing unit group to the turnover unit, the path from the first printing unit is the longest, the path from the second printing unit is the next longest, and the path from the third printing unit is the shortest, wherein among paths from the turnover unit to the printing units of the printing unit group, the path reaching the first printing unit is the longest, the path reaching the second printing unit is the next longest, and the path reaching the third printing unit is the shortest, and wherein the control unit controls the path change unit so that the printing medium of which the front surface is printed by the first printing unit is transported to the third printing unit to print the rear surface of the printing medium, the printing medium of which the front surface is printed by the second printing unit is transported to the second printing unit to print the rear surface of the printing medium, and the printing medium of which the front surface is printed by the third printing unit is transported to the first printing unit to print the rear surface of the printing medium.

* * * * *